US011142012B2

(12) United States Patent
DiDomenico

(10) Patent No.: US 11,142,012 B2
(45) Date of Patent: Oct. 12, 2021

(54) REMOVABLE DRYER MODULE FOR A PRINTING APPARATUS

(71) Applicant: XEROX CORPORATION, Norwalk, CT (US)

(72) Inventor: Gilles DiDomenico, Marseilles (FR)

(73) Assignee: Xerox Corporation, Norwalk, CT (US)

( * ) Notice: Subject to any disclaimer, the term of this patent is extended or adjusted under 35 U.S.C. 154(b) by 403 days.

(21) Appl. No.: 15/424,958

(22) Filed: Feb. 6, 2017

(65) Prior Publication Data

US 2017/0341447 A1 Nov. 30, 2017

Related U.S. Application Data

(60) Provisional application No. 62/341,249, filed on May 25, 2016.

(51) Int. Cl.

| | |
|---|---|
| ***B41J 11/00*** | (2006.01) |
| ***B41L 23/20*** | (2006.01) |
| ***B41F 23/04*** | (2006.01) |

(52) U.S. Cl.

CPC ..... *B41L 23/20* (2013.01); *B41F 23/0403* (2013.01); *B41F 23/044* (2013.01); *B41J 11/002* (2013.01)

(58) Field of Classification Search

None

See application file for complete search history.

(56) References Cited

U.S. PATENT DOCUMENTS

| | | | | |
|---|---|---|---|---|
| 3,654,459 A * | 4/1972 | Coleman | G21K 5/10 118/620 |
| 4,545,131 A * | 10/1985 | Ericsson | B41F 23/0443 118/642 |
| 6,278,472 B1 * | 8/2001 | Sasaki | B41J 2/32 347/175 |
| 7,089,686 B2 * | 8/2006 | Lange | B05D 3/067 34/278 |
| 8,026,493 B2 * | 9/2011 | Grossman | A23L 3/3436 250/453.11 |

* cited by examiner

*Primary Examiner* — Alejandro Valencia

(74) *Attorney, Agent, or Firm* — Maginot Moore & Beck LLP

(57) ABSTRACT

A printing apparatus, such as a large-scale ink jet printer, includes two removable, interchangeable dryer modules, which may be operated separately or in series. Each dryer module permits a sheet or web to pass therethrough in a process direction. Each dryer module includes a lamp mount, suitable for holding one or more heating or curing lamps, the lamp mount being slidably disposed within the module for easy access to the lamps. Each dryer module defines a top portion suitable for maintaining an airflow above the lamp mount, and a bottom portion suitable for maintaining an airflow below the lamp mount. A plate having a pattern of openings therein enables an airflow through the lamps.

6 Claims, 3 Drawing Sheets

REMOVABLE DRYER MODULE FOR A PRINTING APPARATUS

CLAIM OF PRIORITY FROM PROVISIONAL APPLICATION

The present application claims priority from U.S. Provisional Application Ser. No. 62/341,249, filed May 25, 2016.

TECHNICAL FIELD

The present disclosure relates to a dryer module suitable for use in a large-scale, high-volume printing apparatus.

BACKGROUND

In many types of printing, particularly ink-jet printing, there is a need to dry or cure ink placed on a sheet quickly. In a large-scale, high volume ink-jet printing application, particularly where full-color images are placed on a fast-moving continuous web, drying, curing or other treatment of the web is typically performed by an elaborate drying or curing system.

In a print-shop environment, different print jobs may have different requirements. For example, some jobs may require high speed, while others require high quality, such as could be obtained only with multiple passes with multiple color inks, which may in turn require specialized or extended drying, curing or other treatment steps. Jobs that require specialized inks, such as MICR or metallic inks, may also require specialized or extended drying, curing or other treatment steps. It is desirable, then, to facilitate flexibility in drying or otherwise treating sheets in a variety of print jobs.

SUMMARY

According to one aspect, there is provided a dryer module for use in printing. A cabinet forms a chamber with a top portion and a bottom portion. The cabinet defines a plurality of sheet slots, for passage of a sheet through the chamber in a process direction. A lamp mount, suitable for holding one or more lamps, is slidably disposed relative to the cabinet, whereby the lamp mount may be at least partially removed from the chamber for access to at least one lamp. The cabinet defines a first air opening and a second air opening, suitable for permitting a first airflow through the top portion of the chamber, the first airflow passing over the lamp mount, transverse to the process direction. The cabinet defines a third air opening and a fourth air opening, the third air opening permitting air to enter the bottom portion of the chamber, permitting a second airflow through the bottom portion of the chamber, the second airflow passing under the lamp mount.

According to another aspect, there is provided a printing apparatus having a first dryer module and a second dryer module. For each of the first and second dryer module, a cabinet forms a chamber with a top portion and a bottom portion. The cabinet defines a plurality of sheet slots, for passage of a sheet through the chamber in a process direction. A lamp mount, suitable for holding one or more lamps, is slidably disposed relative to the cabinet, whereby the lamp mount may be at least partially removed from the chamber for access to at least one lamp. The cabinet defines a first air opening and a second air opening, suitable for permitting a first airflow through the top portion of the chamber, the first airflow passing over the lamp mount, transverse to the process direction. The cabinet defines a third air opening and a fourth air opening, the third air opening permitting air to enter the bottom portion of the chamber, permitting a second airflow through the bottom portion of the chamber, the second airflow passing under the lamp mount.

According to another aspect, there is provided a printing apparatus comprising a first dryer module and a second dryer module, each dryer module including a cabinet defining a plurality of sheet slots, for passage of a substrate through the chamber in a process direction, and a lamp mount, suitable for holding one or more lamps. The first dryer module and the second dryer module are interchangeable in position within the printing apparatus.

DETAILED DESCRIPTION

Figure 1:
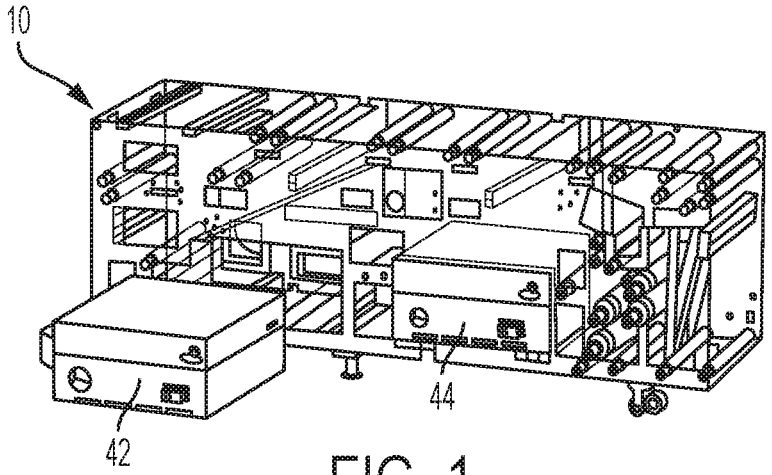
FIG. 1 is a perspective view of the frame of a high-volume printing apparatus.

FIG. 1 is a perspective view of the frame of a high-volume printing apparatus generally indicated as 10. In the particular architecture shown, a continuous web, such as of paper, is moved along the rollers at the top of the frame, where it is printed upon by a set of printheads (not shown). The web, having ink freshly placed thereon, can then be directed through one or more dryer modules, indicated as 42 and 44. In the Figure, dryer module 42 is shown removed from apparatus 10, while module 44 is shown in place to permit a sheet or web to pass through.

Figure 2:
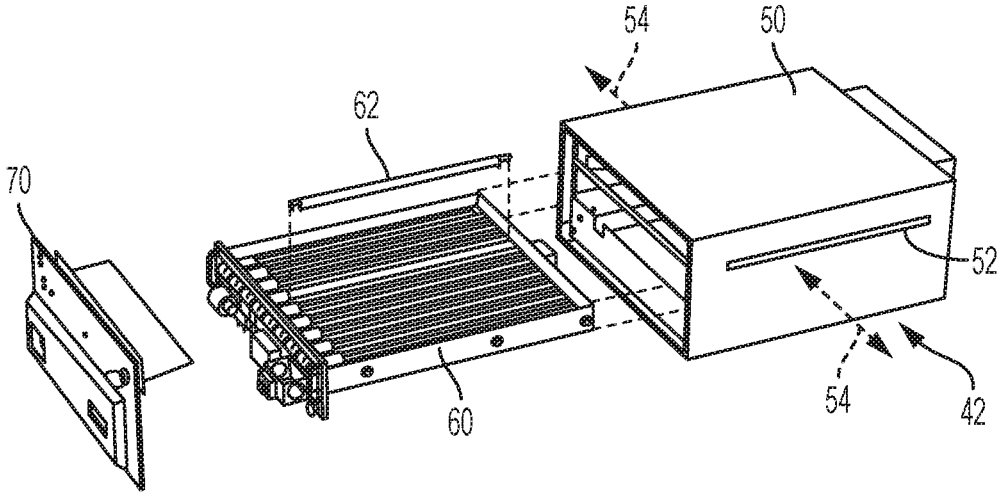
FIG. 2 is a perspective, partially exploded view of a single dryer module in isolation.

FIG. 2 is a perspective, partially exploded view of a single dryer module such as 42 in isolation. Dryer module 42 comprises a generally rectangular cabinet 50, defining a loosely enclosed chamber. The side walls of chamber 50 define sheet slots such as 52 (with another slot, not visible in the Figure) through which paper or other substrate, such as but not necessarily in the form of a continuous web, can pass through the chamber in process direction 54, in either direction depending on the larger architecture of printing apparatus 10.

Also shown in FIG. 2 is a lamp mount 60, which holds and conveys electrical power (through circuitry, not shown) to any number of lamps 62, one of which is shown in isolation in the exploded view. The lamps 62 can be of any type known in the art of drying or curing ink or other marking material on printed sheets, and could also include simple resistive elements. As shown in the embodiment, the lamps 62 extend transversely relative to the process direction 54 through which sheets or a web pass. In an alternate embodiment, lamps 62 can be mounted along the process direction and therefore be selectably turned on according to the paper width passing through the dryer module; i.e., only a subset of lamps corresponding to the width of a sheet or web being fed at the time need be activated.

In operation, the lamp mount 60 is slidably disposed in chamber 50, where connections are made (such as with plugs or other contacts, not shown) with the power supply of the printing apparatus 10. As shown, the lamp mount 60 may be at least partially removed from the chamber of cabinet 50 for access to at least one lamp 62. Lamp mount 60 is slidably mounted within cabinet 50 so that lamps such as 62 can be easily replaced as needed, whether the module such as 42 is installed in apparatus 10 or not. As used herein, the term "slidably" need not require specialized hardware or structures, such as rollers, handles, etc. A cover plate 70 is used to further enclose the cabinet 50, and may also include or interact with safety features such as a switch which prevents, for example, energizing of the lamps 62 if the cover plate 70 is not installed correctly. In an embodiment, the cover plate 70 could be removed or otherwise opened for access to lamp mount 62 even if the module 42 is still disposed within the frame of printing apparatus 10.

With reference to the larger context of a printing apparatus 10 such as shown in FIG. 1, in the particular embodiment shown, a web with freshly-placed ink thereon passes through slots 52 of a dryer module such as 42 (or through both modules 42, 44) with the inked side facing downward, above and facing toward lamps 62. Further structures, not shown, may be provided within cabinet 50 to prevent direct contact of the sheet or web with any of the lamps 62.

Figure 3:
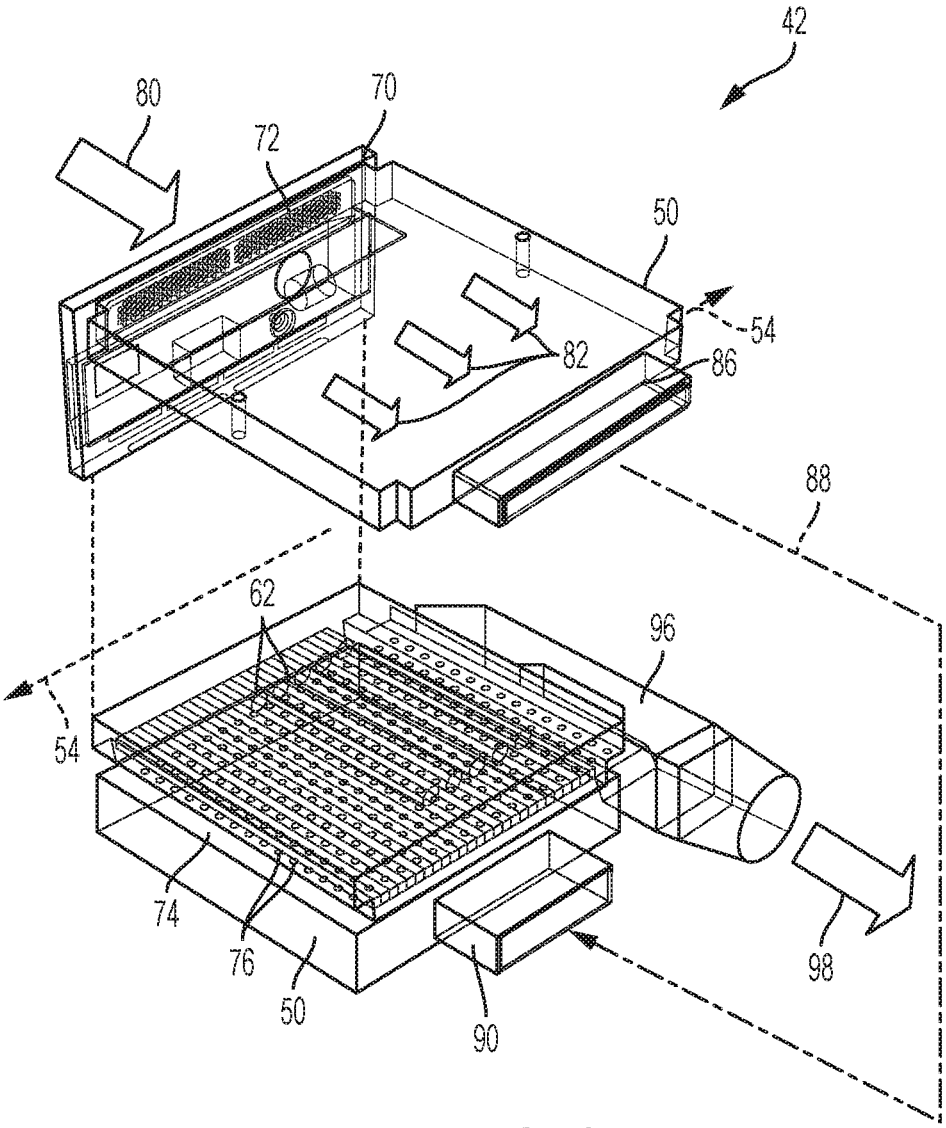
FIG. 3 is an exploded view of a dryer module, showing airflows when the module is in operation within a printing apparatus.

FIG. 3 is an exploded view of a dryer module 42, showing airflows within cabinet 50 (here shown in two parts) when the module 42 is in operation within a printing apparatus 10. In FIG. 3, sheets or a web pass through process direction 54, with the slots 52 as shown in FIG. 2 being formed between the two portions of cabinet 50. Cover plate 70 defines, toward its top portion, a set of air openings 72, through which air may be drawn. Because of the location of openings 72, air (directly from outside the apparatus 10, or through a specialized air supply system, not shown) passes through the top portion of cabinet 50 in the direction shown by arrows 82, over both the upward-facing (non-inked) side of a sheet passing through process direction 54, and also over lamps 62. It will be noted that the direction of airflow 82 is perpendicular to the process direction 54 of a sheet or web moving through the cabinet 50. In this embodiment, the airflow 82 is drawn through an exit manifold 86, out of the cabinet 50; through means within apparatus 10 which will be described in detail below, the drawn air is effectively recirculated through path 88 to re-enter the lower portion of cabinet 50 through inlet manifold 90. This air is ultimately drawn through side manifold 96 and out of the cabinet 50, as shown by arrow 98.

Also as shown in FIG. 3, the top of the lower portion of cabinet 50, just below the lamps 62, includes a plate 74 with a pattern of small openings 76 defined therein. In one embodiment, these openings cause some of the air in lower portion of cabinet 50 to be drawn upward through or between the lamps 62, thereby adding to a cooling effect on the lamps, and also provides a flow of warm air toward the inked side of a sheet or web moving above the lamps 62. In one practical embodiment, the total area of the openings 76 in plate 74 is comparable (within 10%) to the area of opening 90, thereby maintaining a suitable airflow through the lamps 62. Further in a practical embodiment, the speed of sheet S through a dryer module such as 42 is 1 to 4 m/s, which is much lower than the air speed through the top portion of cabinet 50, which is typically about 40 m/s.

Figure 4:
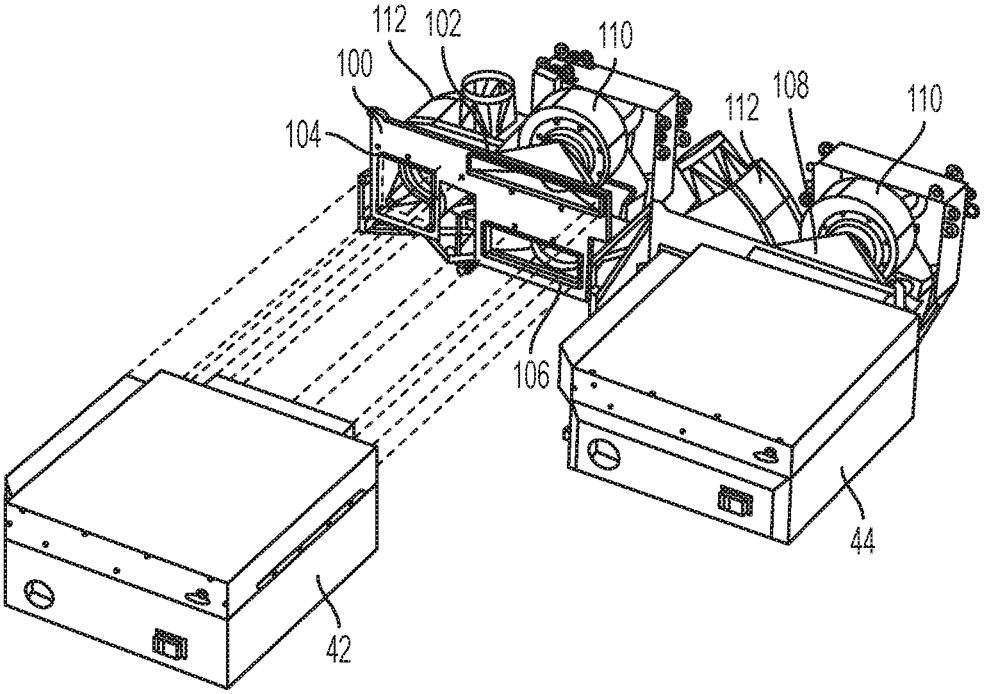
FIG. 4 is a detailed, isolated, perspective view of dryer modules interfacing with structure within a printing apparatus.

FIG. 4 is a detailed, isolated, perspective view of dryer modules 42, 44 interfacing with structure within the printing apparatus 10, showing structure useful in creating such airflows within the dryer modules. For each module 42, 44 installed in apparatus 10, there is provided in apparatus 10 a first suction blower 110, which draws air from the top portion of a cabinet 50 through a funnel manifold 108 and then sends it back, through airflow path 88 as shown in FIG. 3, into the bottom portion of cabinet 50 as described above.

As can be seen in FIG. 4, each structure within apparatus 10 that interfaces mechanically with a module such as 42 or 44 includes an opening to an air manifold. In the illustrated embodiment, and cross-referencing FIG. 3, there is a plate 100 corresponding to a location for each module such as 42, 44 associated with a printing apparatus 10; this plate 100 includes openings 102, 104, 106. Opening 102 corresponds to exit manifold 86 in a module; opening 104 corresponds to side manifold 96 in a module; and opening 106 corresponds to inlet manifold 90 in a module. Associated with each opening 102, 104, 106 in the embodiment are blowers such as 110, 112, arranged as needed to establish airflows relative to each module as shown in FIG. 3, in particular recirculation path 88 described above.

Within the context of a printing apparatus such 10 shown in FIG. 1, the overall airflow through a drying module 42 provides a practical advantage in that fresh, cool air moving through top portion of cabinet 50 is also useful in cooling hardware within printing apparatus 10, such as printheads, which are adjacent the top of each module 42, 44.

In the illustrated embodiment, the modules 42, 44 are effectively mechanically identical and interchangeable in position within printing apparatus 10; further, the modules are designed to be indifferent to which direction along process direction 54 a sheet or web is moving. In a flexible printer design based on the frame shown in FIG. 1, there may be provided one or two dryer modules 42, 44. Depending on a specific implementation, the dryer modules 42, 44 could be operated in series, so that, for instance, a web passes through module 42 and then immediately through module 44, for an extended drying process. Alternatively, if not so much drying or curing power is needed, e.g., to conserve energy, the print apparatus 10 could be operated with only one module such as 42 energized to perform drying, and the other module 44 turned off or removed.

As used herein, a "dryer" or "dryer module" shall be defined as any hardware that provides energy, such as radiant heat, convective heat, ultraviolet light, etc., to a sheet or to an image or partial image placed on a sheet at any point in an overall printing process. Also, the action of a dryer or dryer module ("drying") shall also include curing of ink, toner, or other marking material, or causing any other chemical reaction in ink, toner, or other marking material. When it is stated that paper is caused to move "through" a dryer or drying module, it is meant the paper is placed relative to the dryer or drying module in such a way that the dryer or drying module influences (such as by heating, drying, or curing) the ink, toner, or other marking material and/or the sheet itself. Such influencing can occur before or after any image or partial image is placed on the sheet, i.e., includes pre-heating or pre-treating. As used herein, the term "sheet" shall include any type of substrate on which an image is desired to be printed, regardless of the material thereof (e.g., paper, plastic, etc.), and shall include discrete sheets or a continuous web.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A dryer module for use in printing comprising:

a cabinet having a plurality of walls that form a rectangular chamber, a first wall of the cabinet has a first slot at a first predetermined distance from where a longest side of the first wall of the cabinet joins a second wall of the cabinet, and a third wall of the cabinet that is directly opposite the first wall of the cabinet has a second slot at the first predetermined distance from where a longest side of the third wall joins the second wall so the second wall extends from the first wall to the third wall, a horizontal only sheet path extends from the first slot to the second slot so sheets enter the chamber through the first slot in the first wall of the cabinet and pass along the horizontal only sheet path through the chamber in a process direction to the second slot in the third wall and then exit the chamber from the second slot in the third wall of the cabinet;

a first plate that extends from the first wall of the cabinet to the third wall of the cabinet defines a first air opening and a fourth wall of the cabinet defines a second air opening that is opposite the first air opening so a first airflow passes through the chamber from the first air opening in the first plate over the horizontal only sheet path in the chamber in a direction that is perpendicular to the process direction and then exits through the second air opening in the fourth wall of the cabinet, the fourth wall of the cabinet also defines a third air opening that is vertically displaced from the second air opening in the fourth wall and the first wall of the cabinet defines a fourth air opening that is vertically displaced from the first slot in the first wall of the cabinet, the third air opening being configured to receive air exiting the second air opening in the fourth wall and directs the air from the second air opening in the fourth wall into the chamber within the cabinet below the horizontal only sheet path so the air flows beneath the horizontal only sheet path in a direction opposite the first airflow before exiting the chamber through the fourth air opening in the first wall;

a manifold having at least one wall that defines an enclosed volume, the manifold having a first opening that fluidly communicates with the fourth air opening in the first wall of the cabinet to direct air exiting the chamber from the fourth air opening into the first opening of the manifold and then through the manifold in a direction that is parallel to the first airflow to a second opening in the manifold;

a lamp mount configured to hold one or more lamps, the lamp mount being positioned between the horizontal only sheet path and the air flow between the third air opening and the fourth air opening; and a second plate positioned between the lamp mount and the air flow between the third air opening in the fourth wall and the fourth air opening in the first wall, the second plate having a plurality of air openings that move air from the air flow between the third air opening in the fourth wall and the fourth air opening in the first wall through the air openings in the second plate and past the lamps in the lamp mount before passing through the horizontal only sheet path.

2. The module of claim 1, the plurality of air openings in the second plate defining a total area in the plate approximately equal to 90% of an area of the third air opening in the fourth wall.

3. The module of claim 1 wherein the first plate is configured to attach to the cabinet between the first wall and the third wall, the first plate is detachable from the cabinet to enable the lamp mount to be removed from the cabinet.

4. The module of claim 3 wherein the first air opening in the first plate includes a plurality of air openings that enable air to flow into the chamber to the second air opening in the fourth wall of the cabinet.

5. The module of claim 3 wherein the cabinet is configured to mount within a printing apparatus selectively.

6. The module of claim 1 wherein the lamp mount is configured to orient the lamps so that a longitudinal axis of the lamps extends perpendicular to the process direction.

* * * * *